US008109213B1

(12) United States Patent
Poulos et al.

(10) Patent No.: US 8,109,213 B1
(45) Date of Patent: Feb. 7, 2012

(54) MULTIPURPOSE TARGET BREACHING WARHEAD

(75) Inventors: William Poulos, Park Ridge, NJ (US); David Pfau, Somerset, NJ (US); Eric Scheper, Mt. Arlington, NJ (US); Stewart Gilman, Budd Lake, NJ (US); Vladimir M. Gold, Hillside, NJ (US); Ernest Baker, Wantage, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 221 days.

(21) Appl. No.: 12/649,716

(22) Filed: Dec. 30, 2009

(51) Int. Cl.
*F42B 14/00* (2006.01)

(52) U.S. Cl. ..... 102/524; 102/473; 102/506; 102/517; 102/520; 102/526

(58) Field of Classification Search ..... 102/473, 102/506, 517, 520, 524, 526
See application file for complete search history.

(56) References Cited

U.S. PATENT DOCUMENTS 2,866,412 A * 12/1958 Meyer et al. ..... 102/434
2,938,458 A * 5/1960 O'Brien ..... 102/430
3,705,549 A * 12/1972 Quinlan et al. ..... 102/431
5,182,419 A * 1/1993 Burnette ..... 102/523
5,328,130 A * 7/1994 Gilman et al. ..... 244/3.23
6,405,628 B1 * 6/2002 Goldstein ..... 89/1.15
6,575,097 B1 * 6/2003 Nodarse et al. ..... 102/434
6,591,731 B2 * 7/2003 Goldstein ..... 89/1.15
6,978,967 B1 * 12/2005 Scheper et al. ..... 244/3.24
6,983,699 B1 * 1/2006 Gold et al. ..... 102/495
7,451,704 B1 * 11/2008 Gold et al. ..... 102/495
7,568,433 B1 * 8/2009 Farina et al. ..... 102/439
7,905,182 B2 * 3/2011 Janik et al. ..... 102/517
2009/0217836 A1 * 9/2009 Dietrich et al. ..... 102/215
* cited by examiner

*Primary Examiner* — Michael David
(74) *Attorney, Agent, or Firm* — Michael C. Sachs

(57) ABSTRACT

A single multipurpose ammunition projectile/warhead is provided, which has the capability of clearing a variety of different types of hardened targets. The single projectile of this invention may be used for breaching steel reinforced concrete walls; may be used against light armor targets; may be used for defeating bunkers; and may also be used for antipersonnel applications. Huge savings in time, money, inventory and logistics are realized through utilizing only this one multipurpose ammunition against all these types of targets. This multipurpose projectile, among other superb capabilities, is able to puncture an eight inch double steel reinforced concrete wall timed to then have its warhead explode into fragments. This allows fragmentation in a more effective, nearly ideal direction. The projectile warhead of made of extremely thick walled 300M steel; with the projectile center of gravity to be located equidistant between a pair of bourrelets, for increased stability.

5 Claims, 3 Drawing Sheets

100

200

MULTIPURPOSE TARGET BREACHING WARHEAD

U.S. GOVERNMENT INTEREST

The inventions described herein may be made, used, or licensed by or for the U.S. Government for U.S. Government purposes.

BACKGROUND AND SUMMARY OF INVENTION

This invention relates to the field of ammunition for breaching a hardened target. There is a long felt need for more effective warheads to breach such targets, and especially a need to have a single projectile, multipurpose in nature, for clearing a variety of different types of targets. Current targets each require a specialized projectile. For example, presently an M830A1 round may be used for breaching steel reinforced concrete walls; an M1028 round may be used against light armor targets; an M830 round may be used for defeating bunkers; and an M908 round may be used for antipersonnel applications. Clearly, if a single projectile could effectively be used for any of these type of targets, huge savings in time, money, and logistics could be realized.

In striking a target barrier wall of steel double reinforced concrete perhaps 8 inches thick, many current projectiles are not able to penetrate very deeply. Most current projectiles launched against such barriers flatten out before being able to penetrate, then explode and the projectile warhead breaks into fragments. Although some warhead fragments will penetrate forward into the barrier as intended, yet many fragments will not and only be deflected off the barrier. Although the flattening may create a larger area of surface impact, the desired effect of clearing the target obstacle from its path isn't necessarily optimized. In most cases, the warhead actually fragments in the opposite direction of the course of the projectile, away from the target, and the barrier does not receive the full effect of the explosive energy. What is needed is a projectile that is able to penetrate comparatively deep into a concrete barrier before exploding, with resulting fragments thereof all penetrating into the target. A projectile is described in this invention which is capable of puncturing a double reinforced concrete wall, projectile essentially fully intact, and only then to have its warhead explode into fragments. This allows fragmentation in a more effective nearly ideal direction.

OBJECTS OF THE INVENTION

It is an object of the present invention to provide an extremely more effective projectile and warhead to breach double steel reinforced concrete barriers, and;

It is a further object of the present invention to also provide an effective projectile and warhead to breach other hardened targets, such as bunkers, light armor and antipersonnel applications, and;

It is a still further object of the present invention to provide a multipurpose projectile and warhead to breach all of double steel reinforced concrete barriers, bunkers, light armor and antipersonnel applications, all with a single projectile, and;

It is a yet another object of the present invention to provide logistical and other savings by providing a single multipurpose projectile for use against a variety of hardened targets, including but not limited to double steel reinforced concrete barriers, bunkers, light armor and antipersonnel applications.

These and other objects, features and advantages of the invention will become more apparent in view of the within detailed descriptions of the invention and in light of the following drawings. It should be understood that the sizes and shapes of the different components in the figures may not be in exact proportion and are shown here for visual clarity and for purpose of explanation.

DETAILED DESCRIPTION

Figure 1:
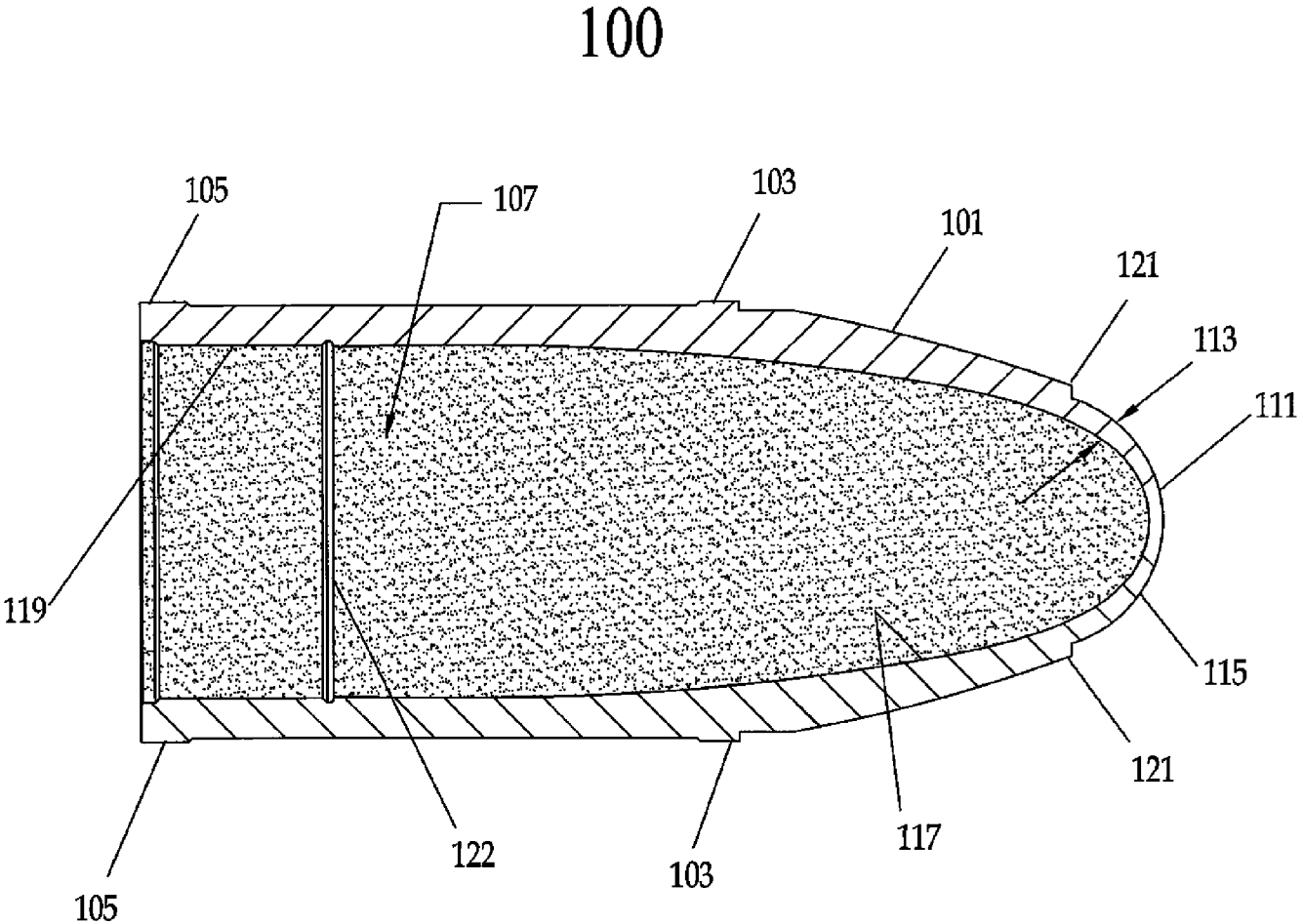
FIG. 1 shows a cross section of a projectile warhead generally according to this invention.
Figure 2:
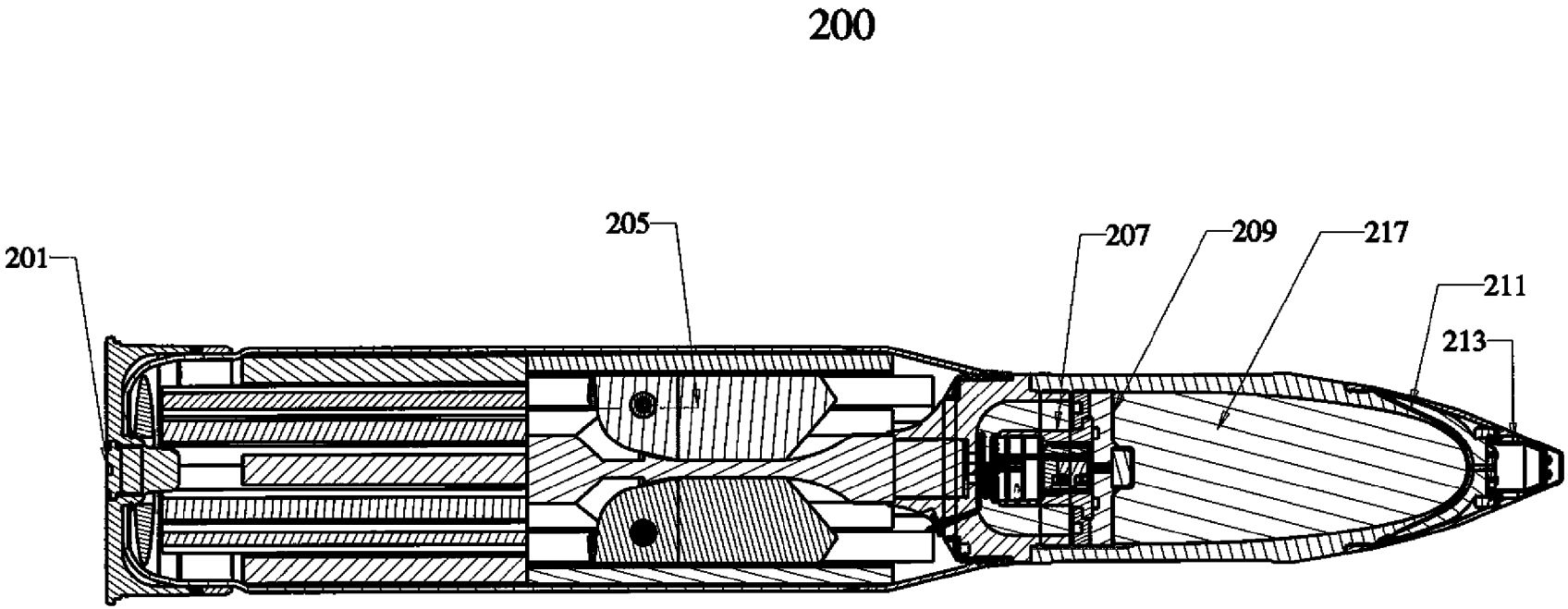
FIG. 2 shows a cross section of an overall cartridge employing the projectile warhead design features according to this invention.
Figure 3B:
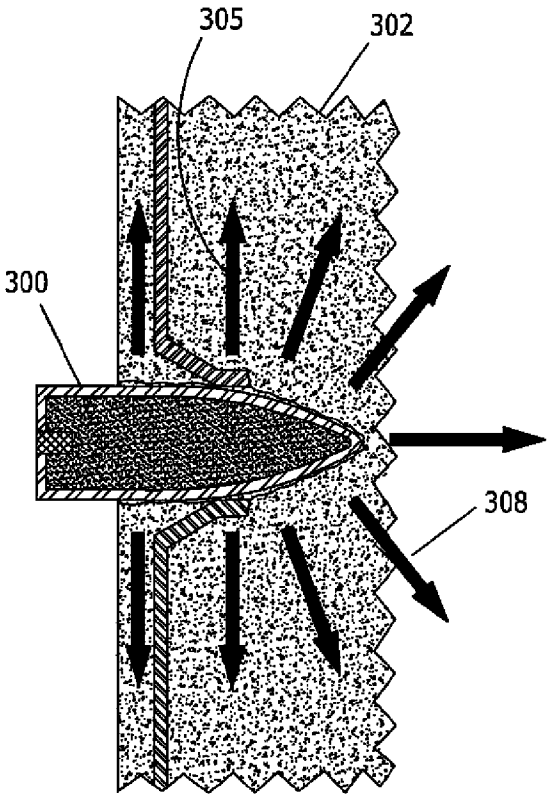
FIG. 3A and FIG. 3B illustrate less successful versus more successful degrees of penetration of a projectile achieved by this invention.
Figure 3A:
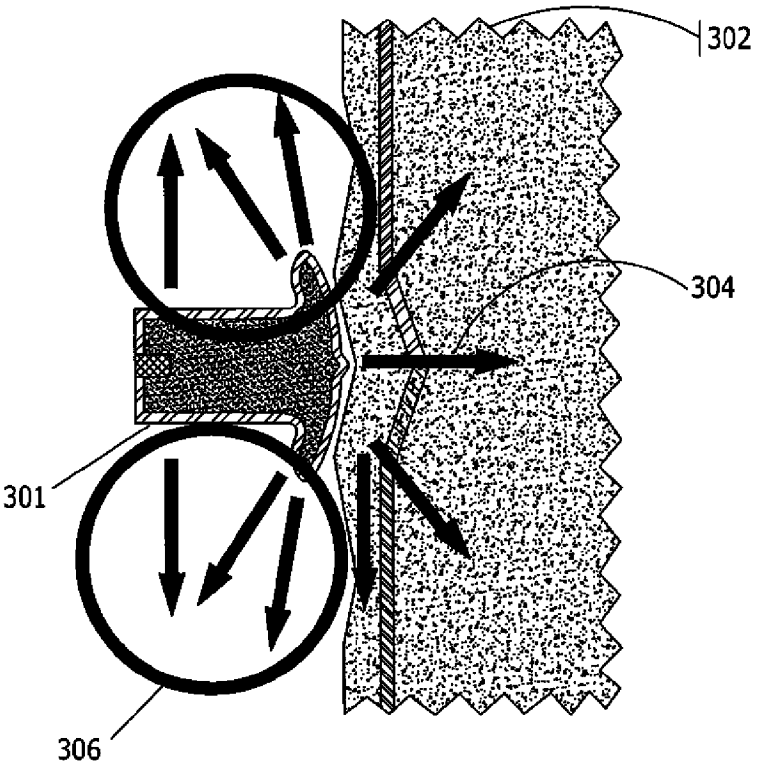

FIG. 1 is a cross section of a projectile warhead generally according to this invention. FIG. 2 shows a cross section of an overall cartridge employing the projectile warhead design features according to this invention. FIG. 3B and FIG. 3A indicate successful versus less successful degrees of penetration of a projectile compared to the benefits of this invention. In a target wall of steel double reinforced concrete 302, perhaps 8 inches thick, many projectiles 301 are not able to penetrate very deeply. The projectile flattens out before being exploded, then its warhead fragments. Although some warhead fragments 304 will penetrate forward into the barrier 302 as intended, yet many fragments 306, e.g., will not accomplish this intent and only be deflected off the barrier 302 as illustrated. Although the flattening creates a larger area of surface impact, the desired effect of clearing the target obstacle from its path isn't necessarily optimized. This is especially true of reinforced targets such as double reinforced concrete walls. In most cases, the warhead fragments in the opposite direction of the course of the projectile. Much fragmentation thus occurs away from the target and it does not receive the full effect of the explosive energy. This invention follows instead the scenario in FIG. 3B. Here, projectile 300 is able to penetrate comparatively deeply into concrete barrier 302 before exploding, with resulting fragments 308 thereof all penetrating into the target 302 (as well as the other fragments such as 305). This projectile is able to puncture a double reinforced concrete wall, projectile fully intact. This allows the explosives to have a better chance of creating the ideal effect. Another advantage is directional in that fragmentation can occur in a more effective direction. And a further advantage is timing. With electronic timed fuzing, the most effective breaching capabilities can be realized. While the invention is described here in terms of breaching reinforced concrete walls, this same projectile is intended to also be able to breach light armor targets, bunkers, used in munitions for urban terrain warfare, and also used for antipersonnel purposes. This is meant to be one projectile (multipurpose) that can accomplish many applications including these. Presently required is an M830A1 for breaching the concrete walls, an M1028 for light armor, an M830 for defeating bunkers, and an M908 for antipersonnel applications. In FIG. 1, a projectile 100 is shown. The casing 101 (with an interior surface 119) is made of 300M steel. This material is much like 4340 steel however, the percentage of silicon has been increased to allow for higher hardenability and an increase in elongation. This material to our knowledge has not been used in any other warhead design. The thickness 113 of the warhead nose 111, combined with the properties of the 300M steel, was designed to allow for a near three times volume expansion (compared to a more conventional projectile). This then increases the fragmentation velocity upon detonation which maximizes the desired effect of the projectile. The outer profile 115 of the nose 111 and the inner profile 117 of the nose 111 are computer generated splines (curved surfaces to connect two or more points) that allow for the maximum explosive energy discharge and maximum fragment velocity. Nose areas 121 are notched. The projectile has midway bourrelets 103 around the outside surface, and also bourrelets 105 at the aft portion of the projectile. They are a ring of material which is softer than the projectile material, to act as seal against propellant gases escaping between the space between projectile and barrel. The bourrelet locations of 103 versus 105 are specifically selected so that the center of gravity 107 of the entire projectile (including all parts from windscreen to boom) is directly in between the two bourrelets; this done to create more bore stability. This means that there is less movement in the barrel of the gun which, in return, allows a more consistent launch. There is a member 122 near the aft area of the round for purposes of support for the casing 101. FIG. 2 shows a full up cartridge 200 utilizing attached at the fore end thereof, a projectile and warhead analogous throughout to the projectile and warhead 100 shown in FIG. 1 hereof, according to this invention. The cartridge has a base data link 201, the back cartridge area is filled with JA-2 propellant; the cartridge includes a front projectile with PAX-3 high explosive 217 (base loaded), a warhead having a pre-fragmented tungsten nose 211, a point detonate switch 213, a base detonating fuze 207 (multi mode programmable), warhead closure disc 209, and a projectile body having folding fins 205.

While the invention has been described with reference to certain embodiments, numerous changes, alterations and modifications to the described embodiments are possible without departing from the spirit and scope of the invention as defined in the appended claims, and equivalents thereof.

What is claimed is:

1. An ammunition cartridge configured to breach and destroy a target, said cartridge comprising a front end and a base end, including JA-2 propellant filling the base end of the cartridge, a data link means at the extreme base end of the cartridge, the cartridge further including a projectile at the front end thereof, said projectile including a warhead made of 300M steel having a nose end comprising a pre-fragmented tungsten nose, said projectile including base loaded PAX-3 high explosive, a point detonate switch, said projectile further having a base detonating multi mode programmable fuze, a warhead closure disc at the projectile's aft end, and said projectile body further having folding fins attached aft said closure disc, said projectile also having a bourrelet ringing the exterior of the projectile at said aft end, and a bourrelet ringing said projectile at a midpoint between the projectile's nose end and said aft end, said midpoint chosen so that the center of gravity of the projectile lies centered between the two bourrelets, and wherein said warhead has an interior surface with a plurality of splines joining points thereon, and an exterior surface also with a plurality of sprines joining points thereon, the shape and location of such splines optimized by computer aided design.

2. The cartridge of claim 1 wherein the target is a steel reinforced concrete wall.

3. The cartridge of claim 1 wherein the target is a bunker.

4. The cartridge of claim 1 wherein the target is light armor.

5. The cartridge of claim 1 wherein it is configured for anti personnel purposes.

* * * * *